United States Patent [19]

Naegeli

[11] 4,010,056

[45] Mar. 1, 1977

[54] PROCESS FOR CONTINUOUSLY BONDING STAPLE FIBERS INTO AN ESSENTIALLY NON-TWISTED YARN

[75] Inventor: Werner Naegeli, Winterthur, Switzerland

[73] Assignee: Pavena AG, Basel, Switzerland

[22] Filed: June 19, 1972

[21] Appl. No.: 263,935

[30] Foreign Application Priority Data

Dec. 22, 1971 Germany ..... 2163958

[52] U.S. Cl. ..... 156/296; 19/66 R; 28/75 R; 57/164; 427/335; 427/365; 427/390 R; 428/361; 428/378

[51] Int. Cl.[2] ..... D06M 13/00

[58] Field of Search ..... 156/62.2, 62.4, 180, 156/296; 161/176; 19/66 R; 57/164; 28/75; 117/119.6, 139.5 C, 139.5 CQ, 65.2; 428/361, 378; 427/335, 365, 390 R

[56] References Cited

UNITED STATES PATENTS

| | | | |
|---|---|---|---|
| 2,689,813 | 9/1954 | Lawrence | 161/176 |
| 2,834,704 | 5/1958 | Lawrence | 156/180 |
| 3,426,389 | 2/1969 | Naegeli | 19/66 |
| 3,432,889 | 3/1969 | Naegeli | 19/66 |
| 3,512,232 | 5/1970 | Bolinger | 161/176 |

*Primary Examiner*—Charles E. Van Horn
*Assistant Examiner*—Michael W. Ball
*Attorney, Agent, or Firm*—Werner W. Kleeman

[57] ABSTRACT

A process for continuously bonding staple fibers into an essentially non-twisted yarn comprising the steps of introducing into a fiber arrangement composed of staple fibers an excess of a liquid containing an adhesive in distributed form, squeezing excess liquid out of the fiber arrangement, compacting the fiber arrangement by applying pressure to form a moist slubbing, and for setting the adhesive and transforming the slubbing into a bonded yarn bringing into contact as by feeding the slubbing into a condensing vapor atmosphere.

The yarn produced according to the aforementioned process, compared to a yarn set in dry air with the same quantity of adhesive, possesses a higher breaking length and rupture or break elongation and a smoother surface.

16 Claims, No Drawings

PROCESS FOR CONTINUOUSLY BONDING STAPLE FIBERS INTO AN ESSENTIALLY NON-TWISTED YARN

BACKGROUND OF THE INVENTION

The present invention relates to a new and improved process for the continuous bonding of staple fibers into an essentially non-twisted yarn and also concerns a new and improved yarn produced according to the aforesaid process.

The textile spinning art is already acquainted with the technique of imbuing a suitably prepared, non-twisted fiber arrangement formed of staple fibers with adhesive distributed in a liquid, squeezing-off the excess liquid while compacting the fiber arrangement at all sides in a pressure zone, and transforming the staple fibers compacted into a band into a yarn by setting the adhesive and drying by means of dry air.

When applying the liquid by means of a liquid applicator or liquid applying device, for instance of the type disclosed in my commonly assigned, copending United States Patent application Ser. No. 187,966, filed Dec. 10, 1971 now abandoned in favor of continuation application Ser. No 347,351, filed Apr. 2, 1973, and entitled "Apparatus For Impregnating Textile Fibers", the staple fibers which are essentially parallely disposed in the fiber arrangement are strongly compacted between work disks of the equipment. Swiss patent No. 541,361 corresponds to abandoned application Ser. No. 187,966. Still there cannot be avoided a certain expansion of the cross-section of the fiber arrangement departing from the work disks, which is dependent upon the fiber material, the degree of crimping of the fibers, the viscosity and nature of the liquid, the introduced liquid quantity or similar factors. Additionally, due to adhesion of the parallely oriented staple fibers at the periphery of the work disks the compactness of the still wet slubbing can further loosen. During drying of the wet slubbing by means of dry air it can be difficult to obtain yarn of sufficient breaking strength and sufficient surface smoothness.

A further drawback is the so-called "sandwich-effect" known to those skilled in the art which particularly occurs in the presence of hydrophilic staple fibers in the fiber arrangement. This sandwich-effect is brought about by virtue of the fact that with swelling of the fibers, which occurs after the introduction of the liquid, there occurs a migration of the liquid from for instance the external or outer cover layer towards the core of the slubbing and internally of the slubbing there is thus present a greater concentration of liquid. Of course, the adhesive distributed in the liquid is also effected thereby and after setting of the adhesive or drying there is obtained a yarn with only insufficient adhesively bonded cover or outer layer, i.e. a yarn possessing for instance a hairy appearance and correspondingly reduced breaking or tear strength. The sandwich-effect is particularly still further then intensified if it is simultaneously desired to maintain as short as possible the time between application of the liquid to the staple fibers and drying of the slubbing, whereby the dimensions of the installation can be desirably reduced.

Furthermore, with the known process it has been found by virtue of the previously discussed effect that the adhesion force of the adhesive distributed throughout the liquid can be only unsatisfactorily utilized, resulting in considerable economical drawbacks.

SUMMARY OF THE INVENTION

Hence, it is a primary object of the present invention to provide an improved method for continuously bonding staple fibers into an essentially non-twisted yarn in a manner which effectively and reliably fulfills the existing need in the art and is not associated with the aforementioned drawbacks of the prior art techniques, and further concerns a new and improved yarn produced according to the aforementioned process of this invention.

The process of this invention for the bonding of staple fibers into an essentially non-twisted yarn overcomes the aforementioned disadvantages in that after introduction of an excess amount of the liquid containing the adhesive in a distributed form into the non-twisted staple fiber arrangement, squeezing-off of the excess liquid out of the fiber arrangement and compacting the fibers into a moist slubbing through application of pressure, this slubbing for the purpose of setting the adhesive and transforming such slubbing into a bonded yarn is fed or otherwise suitably brought into contact with a condensing vapor atmosphere.

Now according to a particular manifestation of the invention the condensing vapor atmosphere can be superheated or overheated and works at a temperature which is at least 20° C above the boiling point of the introduced liquid.

Furthermore, the time between application of the liquid and feeding the slubbing into the condensing vapor atmosphere can amount to less than one second.

The bonded yarn, produced according to the inventive process, manifests itself by a higher breaking strength and greater rupture elongation, compared with a yarn composed of the same staple fibers and set with the same quantity of adhesive in dry air, and furthermore possesses a smoother surface.

DETAILED DESCRIPTION OF THE INVENTION

An excess amount of liquid containing an adhesive distributed therein is continuously introduced in known manner, for instance by means of the liquid applying device disclosed in the aforementioned U.S. patent application Ser. No. 187,966, into a suitably prepared staple fiber arrangement. By squeezing-off the excess liquid and compacting the fiber arrangement there is produced a slubbing or the like containing a certain quantity of a still moist not yet set adhesive, which is immediately subjected to drying and thus transformed into a yarn. With throughpassage velocities of 100 to greater than 300 m/min. and at the same time small dimensions of the installation the time between application of the liquid and starting drying amounts to less than one second.

Owing to the expansion in cross-section which is present after departing from the pressure zone and possibly a further loosening of the compactness of the fine band due to adhesion of the staple fibers at the working or work disks of the liquid applying device there should result, upon setting of the adhesive in dry air, a loosened hairy yarn with lesser breaking or tear strength and poorly utilized adhesive and, in the case of hydrophilic fibers, the quality of the yarn is still further reduced owing to the aforementioned sandwich-effect.

Suppression of such drawbacks requires a specific drying technique which, now according to the teachings of the invention resides in the features that the moist slubbing is supplied into, or otherwise suitably brought into contact with, a condensing vapor atmosphere. With this procedure there preferably occurs a shock-like condensation of liquid at the surface of the slubbing which, as can be readily calculated, can amount to about 10 to 15 percent based upon the weight of the slubbing after introduction of the liquid. In order to increase the quantity of the condensate at the surface of the slubbing it is possible to maintain the quantity of the introduced liquid as large as possible and the temperature of the introduced liquid and the fiber material as low as possible, for instance at room temperature. Moreover, the slubbing prior to feeding same into contact with the condensing vapor atmosphere can be further sprayed with liquid in order to additionally increase the quantity of applied liquid.

As has been found in practice it is possible to extensively reduce the previously discussed loosening of the structure of the slubbing by the condensation of liquid at the surface of the slubbing and, for instance, additionally by carrying out a suitable stretching or tensioning of the slubbing. This is so because fibers protruding from the surface of the slubbing tend to again completely bear against the body of the slubbing owing to the prevailing capillary action. At the same time there is made the best possible use of the adhesion or bonding force of the adhesive introduced into the liquid and upon completion of the drying operation there results an adhesively bonded yarn which, for instance, is manifested by its high breaking strength and rupture elongation as well as also by its extremely smooth surface.

The condensing vapor atmosphere can be generated by evaporation or vaporization and possibly subsequent superheating or overheating of the liquid introduced into the slubbing. In order to initiate the continuous course of the process, that is for the initial production of the condensing vapor atmosphere liquid can be atomized, vaporized and possibly superheated. Superheating of the vapor atmosphere has, for instance, proven to be advantageous for the purpose of increasing the affect of the condensation and drying, and therefore, it is preferred to maintain the condensing vapor atmosphere at a temperature which is at least 20° C above the boiling point of the introduced liquid.

After completion of the condensation-heating of the slubbing the primary and secondary applied liquid, while simultaneously setting the adhesive, can be again evaporated or vaporized and the thus formed adhesively bonded yarn, following removal from the vapor atmosphere and passage through a cooling zone, can be wound practically without twist upon a bobbin or the like.

The invention will now be further explained in conjunction with the following exemplary examples:

EXAMPLE I

In a first process stage and for instance as disclosed in Swiss patent No. 426,704 or U.S. Pat. No. 3,426,389, a stable band of 1550 tex and formed of acrylic fibers sold under the trademark "DRALON" of the well-known German concern Bayer, Leverkusen, West German, of 1.4 denier and a staple length of 40 millimeters is dyed with a light-fast dye known as "DEORLIN-LICHT" of the Swiss concern, Ciba-Geigy, of Basel, Switzerland. With eight-fold doubling this stable band is delivered in a further process step to a single-zone drafting arrangement and attenuated with a draft of 86 to 180 tex and delivered to a liquid applicator device, for instance of the type disclosed in the aforementioned U.S. patent application Ser. No. 187,966. After application at room temperature of the liquid containing the adhesive in distributed form there is present a compacted, still moist slubbing. Suitable as the introduced liquid is a 50 percent aqueous solution of the size or sizing agent PE, fabricated by the well-known German concern BASF of Ludwigshaven, West Germany. Directly after introduction of the liquid, i.e. in less than 1 second after leaving the impregnation device, the slubbing is continuously subjected to a drying process and after completion of drying and passing through a cooling zone this slubbing is wound at room temperature upon a bobbin. Drying occurs with dry air at a temperature of 90° and 140° C respectively. In the dried condition the yarn essentially free of twist and consisting of bonded staple fibers is clamped in a tensile tester of the concern Instron Limited of High Wycombe, Bucks, England and the breaking or tear strength and its rupture or breaking elongation is determined. The necessary recalculations gave a breaking length value in breaking or tear kilometers (Rkm). In the present case such amounted to 6.4 and 7.5 Rkm respectively for a rupture elongation of 4.2 and 5.2 percent respectively.

Now instead of carrying out the drying operation in dry air a slubbing treated in the same manner with adhesive is introduced into a condensing vapor atmosphere at 140° C and having a vapor content of approximately 90 percent by volume. After completion of the drying operation and passage through a cooling zone such is wound likewise at room temperature in the form of a yarn upon a bobbin. Tests carried out at the aforementioned tensile tester and the calculations resulted in a breaking length of 12.8 Rkm with a breaking or rupture elongation of 12.4 percent.

A comparison of these results shows that by virtue of the specific drying technique, namely owing to the direct infeed of the moist slubbing into the condensing vapor atmosphere, i.e. with simultaneous smallest dimensions of the installation, there can be realized a considerably greater breaking strength and a considerably greater rupture elongation. In particular, in many instances it is only possible with these process procedures to fulfill the highest requirements as concerns yarn values, as such for instance are required when using a bonded staple fiber yarn as warp material. In this field of use it is even possible to oftentimes dispense with the warp sizing required for normal twisted yarns, resulting in a considerable saving in the processing costs. Additionally, such yarns manifest themselves by an extremely smooth appearance of their surface with very few protruding fibers, so that processing is simplified and the problem of fly or the like is drastically reduced. It is also possible, and this is of economic significance for certain requirements of yarn values for further processing, to achieve a considerable saving in the quantity of adhesive; it is also possible with the same effect to employ other adhesives, such as polyvinyl alcohol, suitable starch derivatives and the like.

EXAMPLE II

A carded raw cotton of American origin with a staple of 11/16 inch is simultaneously dyed in a manner analogous to the procedures explained in Example I in a first process stage with a reactive dye, like CIBACRON of Ciba-Geigy, Basel, Switzerland and adhesively bonded into a stable band of 2380 tex (Ne 0.25). This stable band is presented with eight-fold doubling in a second process stage to a single-zone drafting arrangement, attenuated with a 95-fold draft to 200 tex, again is delivered to a liquid applicator device and after applying a liquid at room temperature containing adhesive in distributed form is delivered in the form of a compacted slubbing. Suitable as the introduced liquid is a 5 percent aqueous solution of sodium algenate, "MANUTEX F" available from the Swiss concern, Firma Chem. Fabrik, Schweizerhall, Basel, Switzerland and commercially available on the market. In order to maintain the dimensions of the installation small the slubbing, less than 1 second after leaving the impregnation device, is continuously subjected to a drying process and after drying and passing through a cooling zone such is wound in the form of a bonded cotton yarn upon a bobbin or the like. Drying takes place with dry air at a temperature of 95° C. Testing of the yarn at the tensile tester and calculations resulted in a breaking length of 6.3 Rkm with a rupture elongation of 2.4 percent; yarn values which in many instances make any further processing impossible.

Instead of drying in dry air a slubbing treated in the same manner with adhesive is introduced into a condensing vapor atmosphere formed from the liquid, this vapor atmosphere being at a temperature of 145° C and having a vapor content exceeding 85 percent by volume. After drying of the slubbing and subsequent cooling such is likewise wound upon a bobbin in the form of a bonded yarn. The yarn tests which were carried out now resulted in a breaking length of 10.1 Rkm and a rupture elongation of 4.7 percent.

Also in this Example the surprising influence of the inventive drying technique is quite clear and oftentimes even renders possible the utilization of a bonded staple fiber yarn. Additionally, as evident by the results, the sandwich-effect feared when working with hydrophilic fiber materials and the therewith associated migration of the adhesive is noticably improved, that is to say, the improved results, for the same quantity of adhesive, are based upon a homogeneous distribution over the cross-section and an improved utilization of the adhesion force or bonding effect of the adhesive.

Of course, it would be possible to replace the adhesive employed in this Example by suitable starch derivatives, polyacrylates, mixtures of different adhesives and so forth, without destroying the effective mechanism of the inventive process, as well as it also being possible to admix to the cotton as hydrophilic fiber during the doubling of the second process stage a pronounced hydrophobic fiber, such as polyester.

EXAMPLE III

In contrast to the previously discussed Examples I and II in this case the production of a bonded and essentially non-twisted staple fiber yarn takes place in a single-stage process.

This Example will be explained on the basis of a crimped polyacrylic nitrile fiber of 3 denier and a staple length of 60 millimeters and which has been previously contracted by thermal treatment:

A carded band of 5,000 tex is presented to a conventional three-cylinder drafting arrangement, attenuated by a 7.6-fold draft to 660 tex, and then presented to a liquid applicator device for instance of the type disclosed in the aforementioned U.S. patent application Ser. No. 187,966. After application of the liquid at room temperature and containing the adhesive in a distributed form such fiber material appears in the form of a compacted slubbing. There can be used as the introduced liquid an 8 percent aqueous solution of a starch derivative "MEYPROGUM NP 25", commercially available from the Swiss concern Meyhall-Chemical, of Kreuzlingen, Switzerland. Immediately after departing from the impregnation device the slubbing is continuously subject to drying and after passing a subsequent cooling zone is wound in the form of an adhesively bonded yarn upon a bobbin. For comparison purposes drying takes place with dry air at a temperature of 110° C, there resulting a breaking length of 1.7 Rkm and a rupture or breaking elongation of 3.4 percent. On the other hand, treatment of the same slubbing in a superheated or overheated vapor atmosphere at 160° C and a vapor content exceeding 90 percent by volume resulted in an increase of the breaking length of 3.2 Rkm and an increased rupture elongation of 6 percent.

Depending upon the manner of utilizing such yarn during further processing very different requirements can be made as concerns the breaking length and rupture elongation, which can be attained in all cases by practicing the process of this invention and in contrast to drying with dry air can be realized with a minimum quantity of adhesive.

While there is shown and described present preferred embodiments of the invention, it is to be distinctly understood that the invention is not limited thereto but may be otherwise variously embodied and practiced within the scope of the following claims.

What is claimed is:

1. A process for the continuous bonding of staple fibers into an essentially non-twisted yarn, comprising the steps of introducing an excess amount of liquid containing an adhesive in distributed form into a fiber arrangement composed of staple fibers, squeezing out the excess liquid from the fiber arrangement, compacting the fiber arrangement by application of pressure into a moist slubbing, feeding the moist slubbing into contact with a condensing vapor atmosphere for condensing vapor of the vapor atmosphere at the slubbing and setting the adhesive by drying of the slubbing for transforming the slubbing into an adhesively bonded yard.

2. The process as defined in claim 1, including the step of introducing the liquid into the fiber arrangement at room temperature and supplying the moist slubbing at said room temperature into said condensing vapor atmosphere.

3. The process as defined in claim 1, including the step of feeding the moist slubbing into the condensing vapor atmosphere controlled to be in a superheated condition and at a temperature of at least 20° C above the boiling point of the introduced liquid.

4. The process as defined in claim 1 including the step of feeding the moist slubbing into the condensing vapor atmosphere produced by evaporation and subsequent superheating of the liquid introduced into the slubbing.

5. The process as defined in claim 1, further including the step of additionally supplying liquid to the slubbing prior to feeding such into contact with the condensing vapor atmosphere.

6. The process as defined in claim 1, including the step of feeding the moist slubbing into the condensing vapor atmosphere initially produced by atomizing, vaporizing and superheating the liquid.

7. The process as defined in claim 1, including the step of controlling the time of throughpassing of the fiber arrangement between application of the liquid and feeding the slubbing into contact with the condensing vapor atmosphere so as to amount to less than 1 second.

8. The process as defined in claim 1, further including the step of subjecting the yarn to cooling following setting of the adhesive.

9. The process as defined in claim 1, including the step of feeding a moist slubbing comprising staple fibers possessing hydrophilic properties into the condensing atmosphere.

10. The process as defined in claim 1, including the step of feeding a moist slubbing comprising staple fibers possessing hydrophobic properties into the condensing atmosphere.

11. The process as defined in claim 1, including the step of utilizing the yarn as warp material without any sizing treatment.

12. An adhesively bonded yarn produced according to the process of claim 1.

13. The adhesively bonded yarn as defined in claim 12, wherein said yarn, compared with a yarn which has the same quantity of adhesive and set in dry air, possesses a greater breaking length and rupture elongation and a smoother surface.

14. The yarn as defined in claim 13, employed as warp material witout any sizing treatment.

15. The process as defined in claim 1, including the step of drying the slubbing by evaporating the liquid applied to the slubbing for setting the adhesive and transforming the slubbing into adhesively bonded yarn.

16. A process for adhesively bonding staple fibers into an essentially non-twisted yarn, comprising the steps of introducing an excess amount of liquid containing an adhesive in distributed form into a fiber arrangement composed of staple fibers, squeezing out the excess liquid from the fiber arrangement, compacting the fiber arrangement by application of pressure into a moist slubbing, and bringing the slubbing into contact with a condensing vapor atmosphere for suppressing a sandwich-effect by condensing vapor of the vapor atmosphere at the slubbing, and drying the slubbing by evaporating the liquid applied to the slubbing for setting the adhesive and transforming the slubbing into an adhesively bonded yarn.

* * * * *